US006789670B2

(12) United States Patent
Cooper et al.

(10) Patent No.: US 6,789,670 B2
(45) Date of Patent: Sep. 14, 2004

(54) POWER TOOL CARRYING CASE

(75) Inventors: Vincent P. Cooper, Baltimore, MD (US); Jeffrey A. Cooper, Ellicott City, MD (US)

(73) Assignee: Black & Decker Inc., Newark, DE (US)

( * ) Notice: Subject to any disclaimer, the term of this patent is extended or adjusted under 35 U.S.C. 154(b) by 54 days.

(21) Appl. No.: 10/007,147

(22) Filed: Nov. 12, 2001

(65) Prior Publication Data

US 2003/0089630 A1 May 15, 2003

(51) Int. Cl.[7] ..... A45C 11/26
(52) U.S. Cl. ..... 206/349; 206/373; 206/776
(58) Field of Search ..... 206/349, 372–379, 206/351, 775–777; 312/902; 211/70.6; 408/241 R

(56) References Cited

U.S. PATENT DOCUMENTS

| | | | | | |
|---|---|---|---|---|---|
| 380,002 | A | | 3/1888 | Turner | |
| 949,485 | A | * | 2/1910 | Karay | 312/902 |
| 1,352,814 | A | * | 9/1920 | Kirk | 206/314 |
| 3,371,975 | A | * | 3/1968 | Meltzer | 206/349 |
| 3,612,335 | A | | 10/1971 | Schurman | |
| 3,933,243 | A | | 1/1976 | Schurman | |
| 3,983,996 | A | | 10/1976 | Hendren, III | |
| 4,069,915 | A | * | 1/1978 | Schurman | 206/349 |
| 4,303,158 | A | * | 12/1981 | Perkins | 206/373 |
| D291,946 | S | | 9/1987 | Dottori et al. | |
| D293,583 | S | | 1/1988 | Dunlap | |
| 4,768,652 | A | | 9/1988 | Fallon | |
| 4,917,239 | A | | 4/1990 | Smith | |
| 4,934,530 | A | | 6/1990 | Riess | |
| D311,644 | S | | 10/1990 | Chapin et al. | |
| D320,934 | S | | 10/1991 | Cross et al. | |
| 5,366,071 | A | * | 11/1994 | Laszlo | 206/373 |
| 5,368,164 | A | * | 11/1994 | Bennett et al. | 206/373 |
| 5,533,843 | A | | 7/1996 | Chung | |
| 5,570,784 | A | * | 11/1996 | Sidabras et al. | 206/378 |
| 5,622,258 | A | | 4/1997 | Baublitz et al. | |
| D390,357 | S | | 2/1998 | Rosen | |
| D413,203 | S | | 8/1999 | Zurwelle et al. | |
| D413,440 | S | | 9/1999 | Schurman | |
| 6,044,973 | A | * | 4/2000 | Vasudeva | 206/372 |
| D429,884 | S | | 8/2000 | Zurwelle et al. | |
| D440,043 | S | | 4/2001 | Miller et al. | |
| 6,237,767 | B1 | * | 5/2001 | Lee | 206/373 |
| 6,267,238 | B1 | | 7/2001 | Miller et al. | |
| 6,415,923 | B1 | * | 7/2002 | Chen | 206/379 |
| 6,523,687 | B2 | * | 2/2003 | Ling | 206/378 |

* cited by examiner

*Primary Examiner*—Luan K. Bui
*Assistant Examiner*—E. Payton
(74) *Attorney, Agent, or Firm*—Harness, Dickey & Pierce, P.L.C.

(57) ABSTRACT

A tool storage container has a base member with a tool receiving member. A cover is coupled with the base. An opening is in the cover. The opening may have a configuration corresponding to the tool maintained within the carrying case or any other configuration which enables viewing and prohibits removal of the tool when the container is in a closed position. A plurality of storage areas are within the inside of the cover. Also, fingers secure the tool in the carrying case so that in an open condition, the tool is maintained in the carrier.

30 Claims, 3 Drawing Sheets

POWER TOOL CARRYING CASE

FIELD OF THE INVENTION

The present invention relates to a carrying case and, more particularly, to a carrying case which includes storing facilities, as well as a tool viewing area.

Many power tools include carrying cases to protect the tools while the tools are not in use. The carrying cases vary from manufacture to manufacture but generally include a top and a bottom which are pivoted together to enable opening of the container to remove the tool. These containers are satisfactory for protecting the tool when the tool is moved from one place to another. Also, these containers generally require the container, when it is in its open position, to be such that, the top and bottoms rest against a horizontal surface. Thus, the carrying case in the open position does not provide additional functions.

SUMMARY OF THE INVENTION

The present invention provides the art with a power tool carrying case which, while providing storage of the power tool, provides additional storage areas in the carrying case. The present invention provides an area which enables visual inspection of the tool in the case. Also, the present invention enables the container to be mounted vertically while maintaining the tool in the container as well as enabling access to the storage compartments when the container is in an open condition.

In accordance with a first aspect of the invention, a tool storage container comprises a base member with a tool receiving member in the base. A cover is pivotally coupled with the base. An opening is in the cover. The opening ordinarily has a shape corresponding to a tool which is positioned in the base. However, the opening may have any desired shape which enables viewing of the tool. The opening only enables viewing of the tools within the container when the container is in a closed position. The base includes a mechanism to enable it to be mounted to a vertical surface. Accordingly, the cover is pivotal with respect to the base while it is mounted on the vertical surface. The base includes fingers which maintain the tool in the tool receiving member. The opening may include a transparent window covering to enable viewing of the tool. At least one storage area to store a battery or the like is present in the base. An additional finger is adjacent the storage area to maintain the item, such as a battery, in the storage area. The cover, includes at least one storage area. The storage area may include an additional cover pivotally coupled with the storage area. An additional storage device is pivotally mounted on the cover such that the storage device may be pivoted from a use to a non-use position.

According to a second embodiment of the invention, a power tool storage container comprises a base with the base including a tool receiving member. A cover is pivotally coupled with the base. A finger member is positioned adjacent to the tool receiving member. The finger member is movable between a first and second position. In one of the first or second positions, the finger maintains a tool in the tool receiving member. In the other position, the finger enables removal of the tool from the tool retaining member. The base also includes a battery storage area. A second finger member is adjacent the battery storage area to maintain a battery in the battery storage area. The base is adapted to be mounted on a vertical surface while the cover is pivotable with respect to the base while it is mounted. The cover includes a first storage area which may include a pivotal cover. Also, the cover may include a second storage member where the second storage member is pivotal from the use to a non-use position.

According to a third aspect of the invention, a tool storage container comprises a base with the base including a tool receiving member. A cover is pivotally coupled with the base. A storage area is on the cover. The storage area includes a pivotal cover movable between a covered and an uncovered position. The base includes a mechanism to mount the base to a vertical surface with the cover pivotal with respect to the base when it is mounted. A second storage member is coupled with the cover. The second storage member pivots with respect to the cover from a use to a non-use position. Also, the base includes fingers to maintain a tool in the tool receiving members. The fingers are pivotable to enable removal of the tool. The base includes a storage area to receive a battery or the like. A second finger is positioned adjacent to the storage area to retain the item within the area.

In accordance with a fourth aspect of the invention, a tool container comprises a base with the base including a tool receiving member. A cover is pivotally coupled with the base. A storage ledge is pivotal with the cover. The storage ledge pivots between a first position, where the ledge is substantially parallel to the cover, and to a second position, where the ledge is substantially perpendicular to the cover. The storage ledge includes members to retain tools on the ledge. The base includes a mechanism to mount the base on a vertical surface where the cover is pivotable with respect to the base while it is mounted. Fingers are mounted on the base to maintain the tool in the tool receiving member. The base includes a storage area with a finger adjacent the storage area. The cover includes an additional storage area. The additional storage area includes a pivotal cover.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
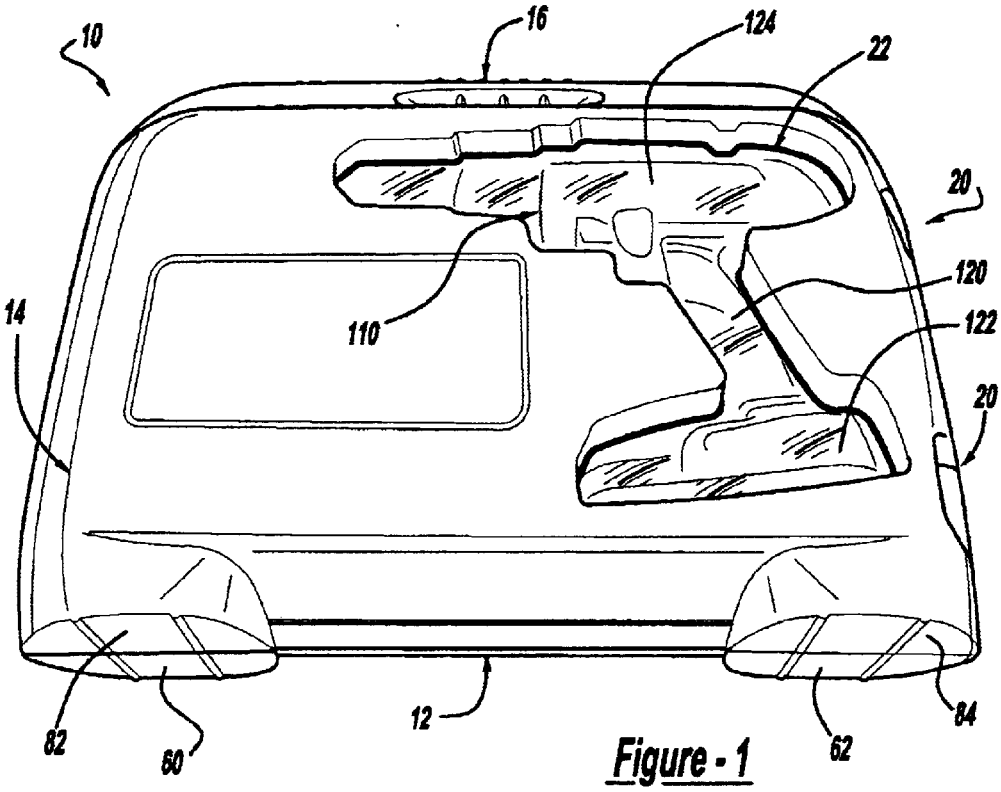
FIG. 1 is a perspective view of a storage container in accordance with the present invention.
Figure 4:
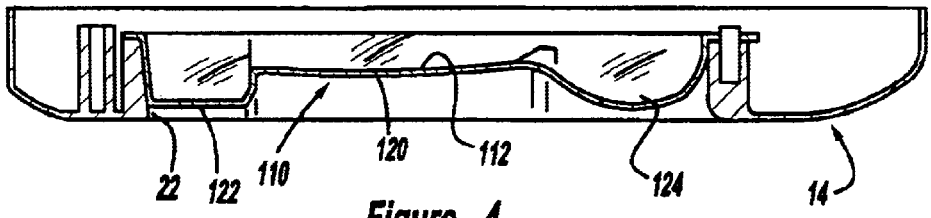
FIG. 4 is a cross section view of FIG. 3 along line 4—4 thereof.

Returning to the Figures, particularly FIG. 1, a power tool carrying case is illustrated and designated with the reference numeral 10. The storage container 10 has a clamshell design with a base 12 and a cover 14. A handle 16 is formed in both members. A hinge 18 couples the base 12 and cover 14 together. Latches 20 removably secure the cover 14 to the base 12. The cover 14 includes an opening 22 which enables viewing of the power tool 24 positioned within the carrying case 10.

Figure 3:
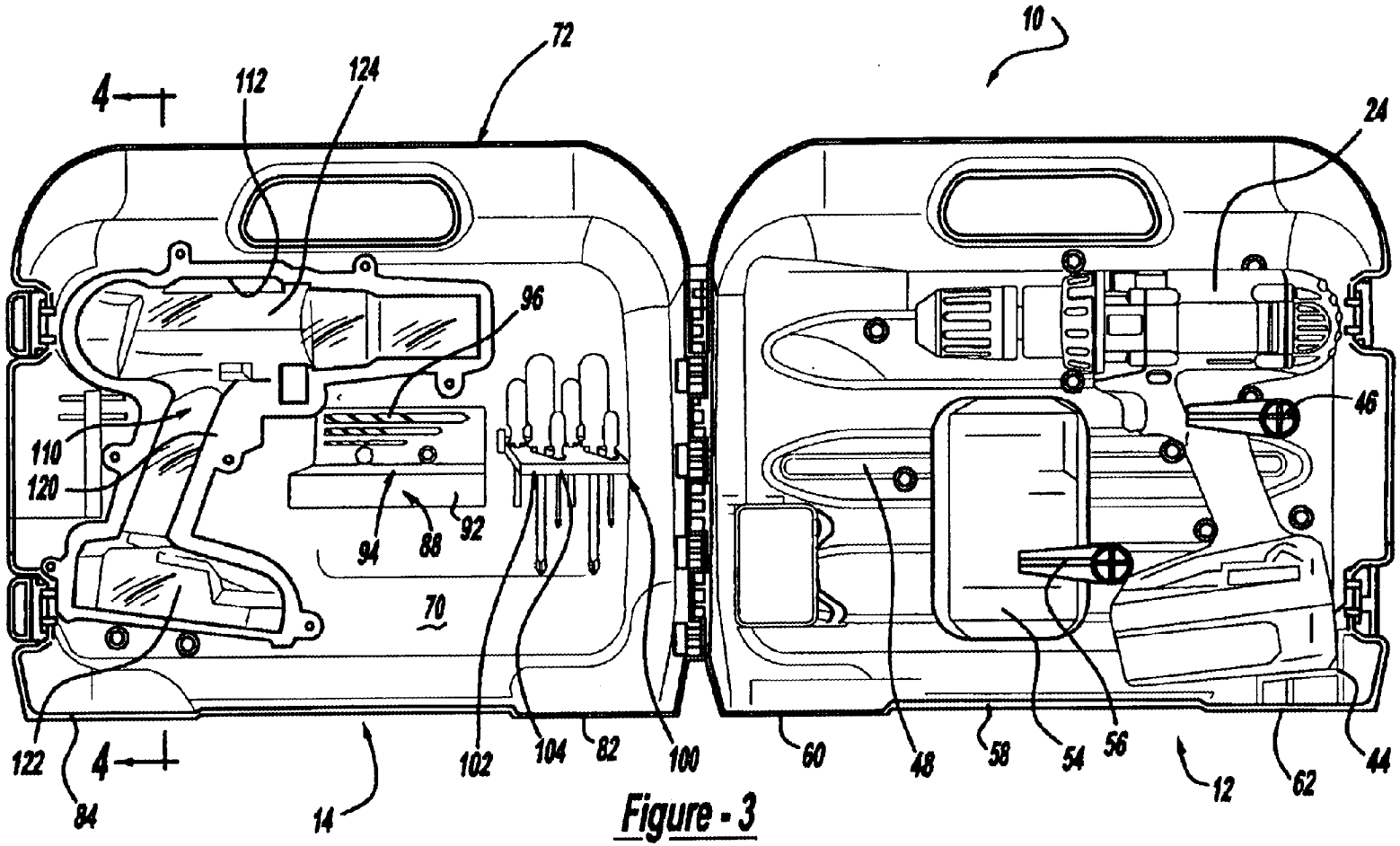
FIG. 3 is a perspective view like FIG. 2, with the tool retained in the base.

The base 12 includes a wall 26 which is surrounded by an extending perimeter skirt 28. Thus the base has an overall rectangular tray shape. Side wall 30 includes a hinge portion which is coupled to the hinge portion of the cover. Side wall 34 includes catches 36 which receive the latches from the cover to hold the two together. The wall 26 includes a tool receiving member 40. A plurality of posts 42 define an outline of the tool. The posts 42 define boundary to prohibit the tool 24 from moving around in the base. A shelf 44 is provided at the bottom of the outline of the tool so that the battery coupled with the power tool rests against the shelf 44. One of the posts includes a finger 46. The finger 46 is movable so that the finger may be positioned on top of the power tool to maintain the power tool in the base 12 as seen in FIG. 3. The base 12 includes a screw channel 48 which enable passage of fasteners through the base to secure the base 12 to a surface. Ordinarily, the surface would be a vertical surface.

The base 12 also includes a storage area 50. The storage 50 may include a wall 52 to define an area to receive an item such as a battery 54. Also, a finger 56 is positioned adjacent to the storage area 50. The finger 56 is movably retained on the base so that the finger may be pivoted to enable removal of the item from the storage area 50. The fingers 46 and 56 enable the carrying case to be positioned such that the wall 26 is perpendicular to a horizontal surface. Thus, the carrying case can stand up on the skirt 28 without the tool falling out of the base 12. Likewise, when the case is mounted to a vertical surface, the fingers 46 and 56 maintain the power tool as well as the storage item in the base. Also, the wall 58 includes feet 60 and 62 which enable the storage case to rest on the feet 60 and 62. Further, the feet 60 and 62 enable the storage case 10 to be positioned perpendicular to a horizontal surface.

The cover 14 is similar to the base 12. The cover 14 includes a wall 70 as well as an extending perimeter wall 72. The side 74 of the wall 72 includes a hinge portion 76 to couple with the hinge portion 32 of the base 12. A pivot pin 78 is slid between the hinge members to couple the two together. Side portion 79 includes latches 20 which removably couple with catches 36 to retain the two halves together. Also, bottom wall 80 includes a pair of feet 82 and 84 which provide a surface to enable the cover to stand alone. The feet 82 and 84 oppose, in a closed condition, the feet 60 and 62 to enable the case to stand while in a closed position.

A first storage container 86 is formed with the cover 14. The storage container 86 has an overall rectangular configuration with a pivoting cover 88. The cover 88 includes a base wall 90 as well as a peripheral extending wall 92. Thus, the cover forms a tray that may hold tools such as bits or the like within the storage area 86. The cover 90 on its wall 92 includes a latch 94 to couple with a catch 96 on the cover 14 to maintain the cover in a closed position.

Figure 2:
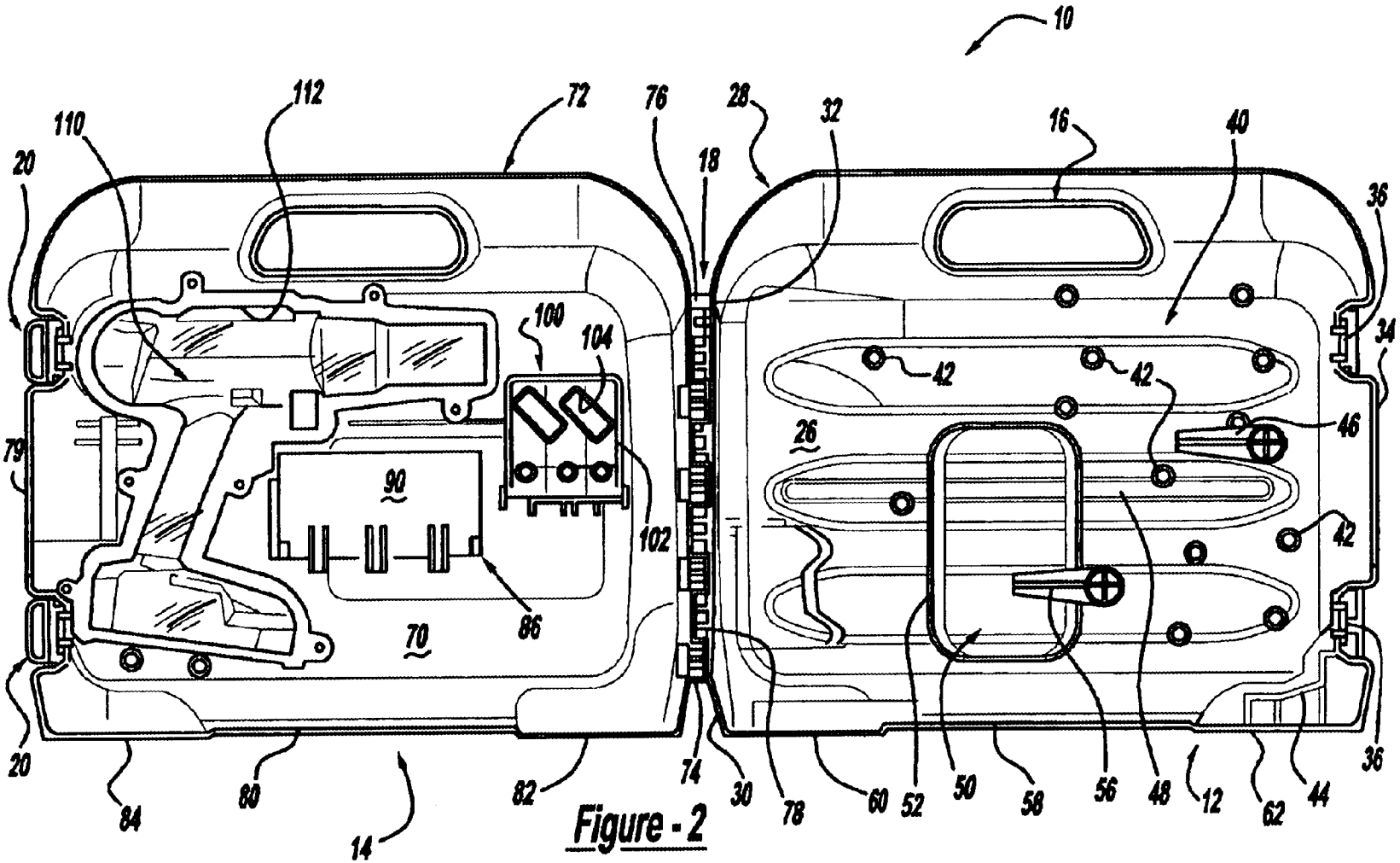
FIG. 2 is a perspective view of the base and cover of the storage container of FIG. 1 in an open condition.

A second storage member 100 is pivotally coupled with the cover 14. The storage area 100 is a pivotal ledge which pivots from a use to a non-use position to hold tools such as screwdrivers, pliers or the like. The ledge 102 includes a plurality of apertures 104 to receive tools. When the ledge 102 is in a use position, the ledge 102 is perpendicular to the wall 70 as seen in FIG. 3. When the base and cover are closed, the ledge 102 is moved upward to a position where it is substantially parallel with the wall 70 so that the base and cover may be closed as seen in FIG. 2.

The cover opening 22 may have any desired configuration to enable only viewing of the tool. The opening may have a geometric shape such as an oval, circle, square, polygonal or the like. However, the opening is sized so that the tool may not be removed from the opening when the case is in a closed position. Also, the opening 22 may be configured like the tool in the container 10. Likewise, the opening is smaller than the tool so that the tool may not be removed through the opening when the container is in a closed position.

The opening 22 includes a transparent window or cover 110. The transparent cover 110 has a contour 112 which receives the contour of the power tool 24. Thus, the transparent cover 110 enables viewing of only the power tool retained within the storage container 10. The contour can be of any design to match the tool within the container. The contour would be a mold of the outer surface of the tool so that it neatly fits around the tool as illustrated in FIG. 1. In the embodiment shown, the cover 110 is that of a drill such that the cover includes a handle portion 120, a base portion 122 and a motor portion 124. These portions cover the drill so that it may be viewed from the outside of the carrying case. Also, the transparent cover could be a flat planar sheet. Here the cover would still have the desired configuration. Further, in the event the opening is geometric or the like as mentioned above, a flat planar transparent cover could be used to enclose the opening. The transparent cover could likewise have a contour or curvature that is not the same as the tool but provides an aesthetic appearance.

While the detailed description of the invention is merely exemplary in nature and, thus, variations that do not depart from the gist of the invention are intended to be within the scope of the invention. Such variations are not to be regarded as a departure from the spirit and scope of the invention.

What is claimed is:

1. A power tool storage container comprising:

a power tool;

a base member;

a cover coupled with said base member;

a power tool receiving member in said base, said power tool receiving member defining an outline of the power tool to be received in said tool receiving member; and an opening in said cover, said opening having a shape corresponding to and following the outline of the power tool for enabling viewing of the power tool to be positioned in said base with a desired size that prohibits removal of the power tool through the cover when the cover and base are coupled together and a transparent window covering said opening and a mechanism in said base for enabling said base to be mounted on a vertical surface with said cover pivotable with respect to said base.

2. The tool storage container according to claim 1 further comprising fingers mounted on said base for maintaining a tool in said tool receiving member.

3. The tool storage container according to claim 2 wherein said finger being pivotal.

4. The tool storage container according to claim 1 wherein said base includes a storage area.

5. The tool storage container according to claim 1 wherein said cover includes a storage area.

6. The tool storage container according to claim 4 wherein said cover includes a storage area.

7. The tool storage container according to claim 5 wherein said storage area includes a cover.

8. The tool storage container according to claim 5 wherein said cover includes a second storage area, said second storage area pivotable with respect to said cover.

9. The tool storage container according to claim 4 wherein a finger is positioned adjacent said storage area for maintaining an item in said storage area.

10. A power tool storage container comprising:

a power tool;

a base, said base including a power tool receiving member defining an outline of the power tool to be received in said power tool receiving member;

a cover pivotally coupled with said base; and a finger member adjacent said tool receiving member, said finger member being movable between a first and a second position, in one of said first or second positions, said finger maintaining said power tool in said power tool receiving member and in said other first or second position, said finger enabling removal of the power tool from said tool receiving member.

11. The power tool storage container according to claim 10 wherein said base includes a battery storage area.

12. The power tool storage container according to claim 11 wherein a second finger member being adjacent said battery storage area.

13. The tool storage container according to claim 10 wherein said base is adapted to be mounted on a vertical surface with said cover pivotable with respect to said base.

14. The tool storage container according to claim 10 wherein said cover includes a storage area.

15. The tool storage container according to claim 14 wherein said cover includes a cover on said storage area.

16. The tool storage container according to claim 14 wherein said cover includes a second storage area, said second storage area pivotable with respect to said cover.

17. A tool storage container comprising:

a base, said base including a tool receiving member defining an outline of the tool to be received in said tool receiving member;

a cover, said cover pivotally coupled with said base; and a storage area on said cover, said storage area including a pivotal cover movable between a covering and non-covering position wherein said cover includes a second storage area, said second storage area pivotable with respect to said cover.

18. The tool storage container according to claim 17 wherein said base is adapted to be mounted on a vertical surface with said cover pivotable with respect to said base.

19. The tool storage container according to claim 17 further comprising fingers mounted on said base for maintaining a tool in said tool receiving member.

20. The tool storage container according to claim 19 wherein said finger being pivotal.

21. The tool storage container according to claim 17 wherein said base includes a storage area.

22. The tool storage container according to claim 25 wherein a finger is positioned adjacent said storage area for maintaining an item in said storage area.

23. A power tool storage container comprising:

a power tool;

a base, said base including a power tool receiving member, a cover pivotally coupled with said base; and a substantially rigid storage ledge pivotally coupled with said cover, said substantially rigid storage ledge pivoting with respect to said cover between a first position wherein said ledge is substantially parallel to said cover in an non-tool retaining position, to a second position wherein said substantially rigid storage ledge is substantially perpendicular to said cover in a tool retaining position where tools pass through said ledge and are maintained perpendicular to said ledge.

24. The storage container according to claim 23 wherein said ledge included members for retaining tools on said ledge.

25. The tool storage container according to claim 23 wherein said base is adapted to be mounted on a vertical surface with said cover pivotable with respect to said base.

26. The tool storage container according to claim 23 further comprising fingers mounted on said base for maintaining a tool in said tool receiving member.

27. The tool storage container according to claim 23 wherein said base includes a storage area.

28. The tool storage container according to claim 23 wherein said cover includes a storage area.

29. The tool storage container according to claim 28 wherein said cover includes a cover on said storage area.

30. The tool storage container according to claim 28 wherein a finger is positioned adjacent said storage area for maintaining an item in said storage area.

* * * * *